US010053266B2

(12) United States Patent
Ho

(10) Patent No.: US 10,053,266 B2
(45) Date of Patent: Aug. 21, 2018

(54) HERMETIC FOOD CONTAINER

(71) Applicant: Shin Hung Yih Technology Co., Ltd., Taipei (TW)

(72) Inventor: Yi-Hung Ho, Taipei (TW)

(73) Assignee: SHIN HUNG YIH TECHNOLOGY CO., LTD., Taipei (TW)

( * ) Notice: Subject to any disclaimer, the term of this patent is extended or adjusted under 35 U.S.C. 154(b) by 243 days.

(21) Appl. No.: 15/210,238

(22) Filed: Jul. 14, 2016

(65) Prior Publication Data

US 2018/0016065 A1 Jan. 18, 2018

(51) Int. Cl.

| | |
|---|---|
| ***B65D 51/16*** | (2006.01) |
| ***B65D 45/32*** | (2006.01) |
| ***B65D 43/02*** | (2006.01) |
| ***B65D 21/02*** | (2006.01) |
| ***B65D 53/02*** | (2006.01) |

(52) U.S. Cl.

CPC ..... *B65D 51/1683* (2013.01); *B65D 21/0209* (2013.01); *B65D 43/0202* (2013.01); *B65D 45/32* (2013.01); *B65D 53/02* (2013.01)

(58) Field of Classification Search

CPC .... B65D 45/32; B65D 43/0202; B65D 53/02; B65D 21/0209; B65D 51/1683

USPC ..... 220/233–238, 367.1, 231; 215/358–361, 215/314, 262

See application file for complete search history.

(56) References Cited

U.S. PATENT DOCUMENTS

| | | | | | |
|---|---|---|---|---|---|
| 3,047,186 | A * | 7/1962 | Serio | A47J 36/06 | 220/231 |
| 3,827,596 | A * | 8/1974 | Powers, Jr. | A47J 36/06 | 220/231 |
| 4,380,302 | A * | 4/1983 | Broad | B01L 3/50825 | 220/235 |
| 4,401,228 | A * | 8/1983 | Baldelli | B65D 39/12 | 215/360 |
| 2003/0197011 | A1* | 10/2003 | Nieh | B65D 81/2015 | 220/231 |
| 2005/0279746 | A1* | 12/2005 | Hsu | B65D 39/12 | 220/234 |
| 2013/0037540 | A1* | 2/2013 | Sze | B65D 43/022 | 220/237 |

FOREIGN PATENT DOCUMENTS

| | | | | |
|---|---|---|---|---|
| EP | 1688359 | A1 * | 8/2006 | B65D 51/1683 |

* cited by examiner

*Primary Examiner* — James N Smalley
(74) *Attorney, Agent, or Firm* — Jackson IPG PLLC; Demian K. Jackson

(57) ABSTRACT

A hermetic food container consisting of a rotary knob, a top cover, a container body, a guide seat and a gasket ring is disclosed. The rotary knob is moved upwards or downwards relative to the top cover to achieve a sealing effect or to create a gap for enabling air to pass therethrough into the container body when the rotary knob is rotated in one of two reversed directions. The use of the gasket ring can effectively reduce wear, enhance durability and prolong the lifespan of the hermetic food container. Further, an anti-slip cushion is provided at the bottom side of the container body, allowing multiple hermetic food containers to be arranged in a stack convenient for storage, package and delivery.

2 Claims, 19 Drawing Sheets

HERMETIC FOOD CONTAINER

BACKGROUND OF THE INVENTION

1. Field of the Invention

The present invention relates to food containers and more particularly, to a hermetic food container, which consists of a rotary knob, a top cover, a container body, a guide seat and a gasket ring, wherein when the rotary knob is rotated in one of two reversed directions, it is moved upwards or downwards relative to the top cover to achieve a sealing effect, or to create a gap for enabling air to pass therethrough into the container body.

2. Description of the Related Art

Conventional hermetic food containers generally provide a hand suction pump or a locking lever for operation to create a vacuum in the container body or to lock the container body in an airtight condition. However, the hand suction pump and the locking lever wear quickly with use, affecting the airtight sealing performance. There is another prior art design using a spring-loaded press control device for pressing by the user to control the sealing condition of the container body. However, after a long use, this prior art design of spring-loaded press control device can fail by elastic fatigue, affecting the airtight sealing performance.

SUMMARY OF THE INVENTION

The present invention has been accomplished under the circumstances in view. It is therefore the main object of the present invention to provide a hermetic food container, which consists of a rotary knob, a top cover, a container body, a guide seat and a gasket ring, wherein when the rotary knob is rotated in one of two reversed directions, it is moved upwards or downwards relative to the top cover to achieve a sealing effect, or to create a gap for enabling air to pass therethrough into the container body.

It is another object of the present invention to provide a hermetic food container, which uses a gasket ring to achieve expected sealing effects, effectively reducing wear, enhancing durability and prolonging the lifespan of the hermetic food container.

It is still another object of the present invention to provide a hermetic food container, which has an anti-slip cushion provided at the bottom side of the container body thereof, allowing multiple hermetic food containers to be arranged in a stack convenient for storage, package and delivery.

DETAILED DESCRIPTION OF THE INVENTION

Figure 1:
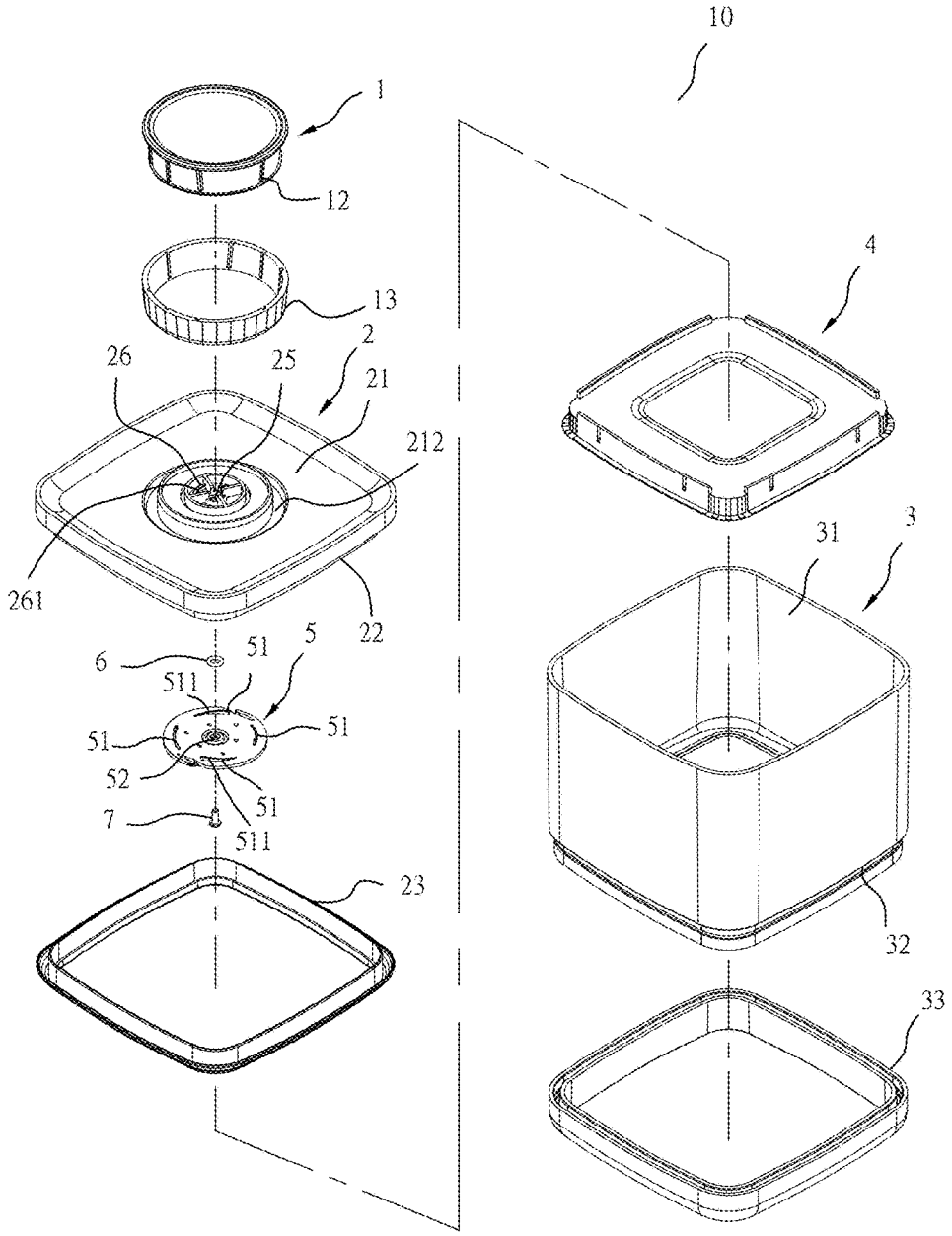
FIG. 1 is an exploded view of a hermetic food container in accordance with a first embodiment of the present invention.
Figure 2:
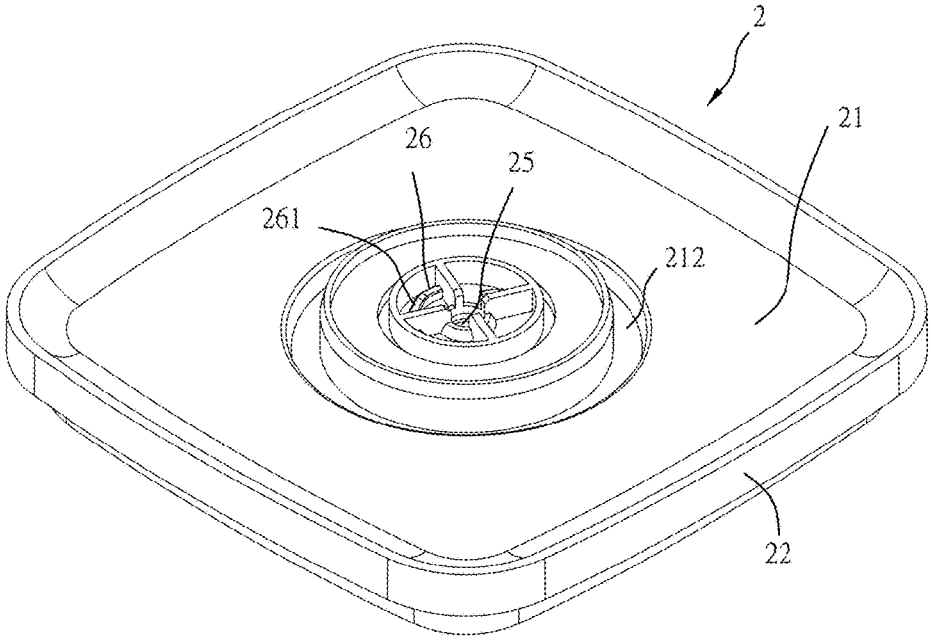
FIG. 2 is an oblique top elevational view of the top cover of the hermetic food container in accordance with the first embodiment of the present invention.

Referring to FIGS. 1-13, a hermetic food container 10 in accordance with a first embodiment of the present invention is shown. The hermetic food container 10 of this first embodiment comprises a rotary knob 1, a top cover 2, a container body 3, an ornamental cover 4, a guide seat 5, and a gasket ring 6.

The rotary knob 1 is rotatably connected to a top side of the top cover 2, comprising a bottom stem 11 (see FIGS. 4 and 5 and FIGS. 10 and 11) downwardly inserted through the top cover 2 and fastened to the guide seat 5 with a fastener 7 (see FIG. 1, FIG. 4 and FIGS. 10 and 11). The bottom stem 11 has a position-limiting groove 111 extended around the periphery near the distal end thereof (see FIG. 6 and FIGS. 10 and 11). The rotary knob 1 further comprises an annular peripheral wall 12, and an anti-slip cushion 13 mounted around the annular peripheral wall 12.

The top cover 2 is capped on the container body 3, comprising a face panel 21, a rim 22 extended around the border of the face panel 21, a packing rubber 23 fastened to the rim 22, a coupling hole 25 (see FIGS. 1, 2, 4, 6, 10 and 11) cut through opposing top and bottom walls of the face panel 21 at the center and rotatably coupled with the bottom stem 11 of the rotary knob 1, and at least one lift guiding block 26 located on the top wall of the face panel 21 (see FIGS. 1, 3, 10 and 11). Each lift guiding block 26 comprises a guiding surface 261 sloping downwardly from one end thereof to an opposite end thereof (see FIG. 3) for guiding the rotary knob 1 to move upward relative to the top cover 2 when the rotary knob 1 is rotated in a first direction, for example, clockwise direction.

The container body 3 defines an open-top storage chamber 31 for storing things or foods.

The ornamental cover 4 is fastened to a bottom side of the top cover 2.

Figure 3:
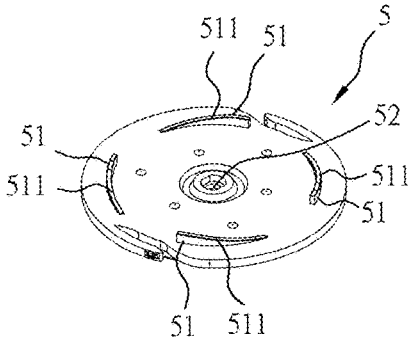
FIG. 3 is an oblique top elevational view of the guide seat of the hermetic food container in accordance with the first embodiment of the present invention.
Figure 11:
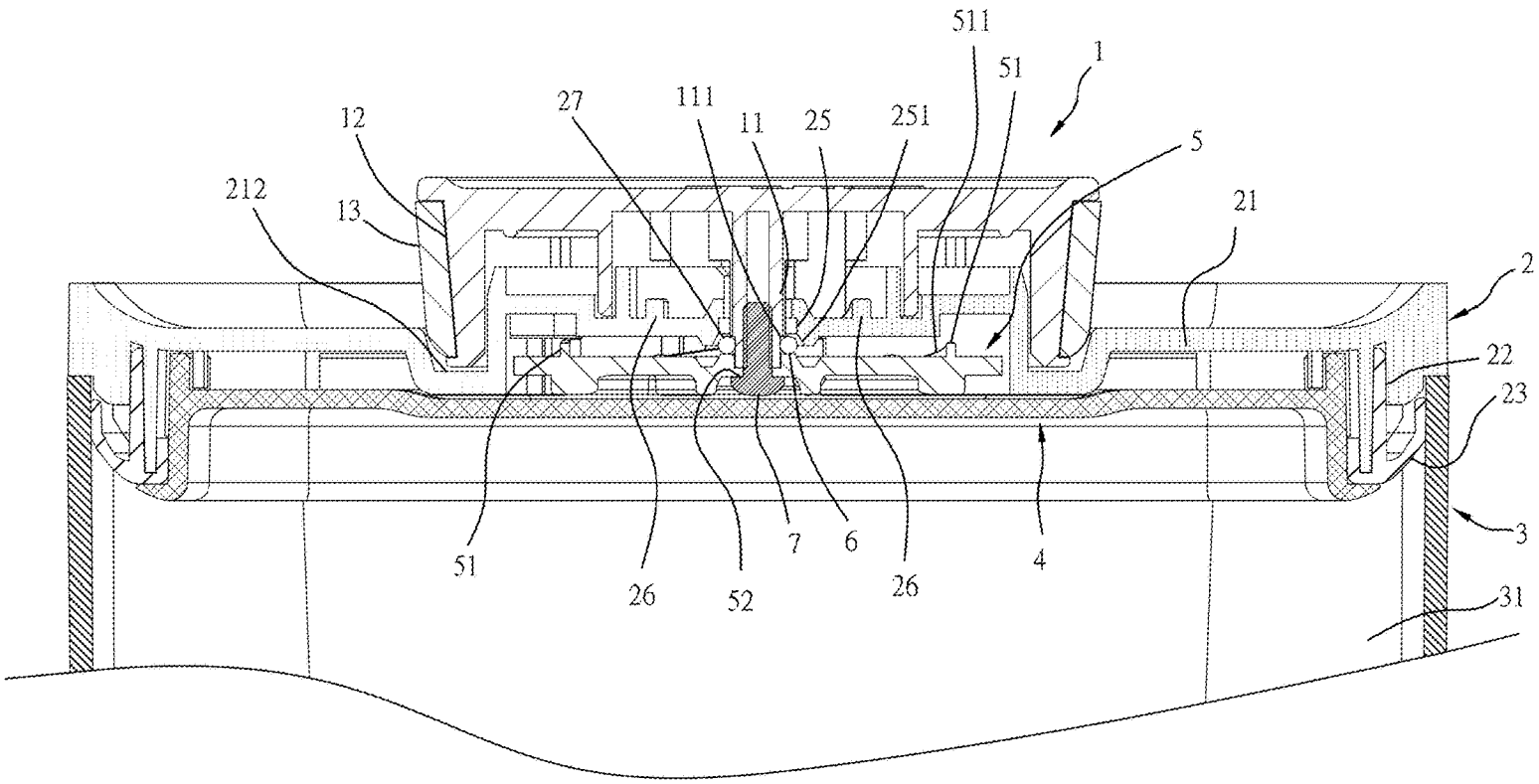
FIG. 11 is similar to FIG. 10, illustrating a gap created between the gasket ring and the inner peripheral wall of the coupling hole of the top cover.
Figure 12:
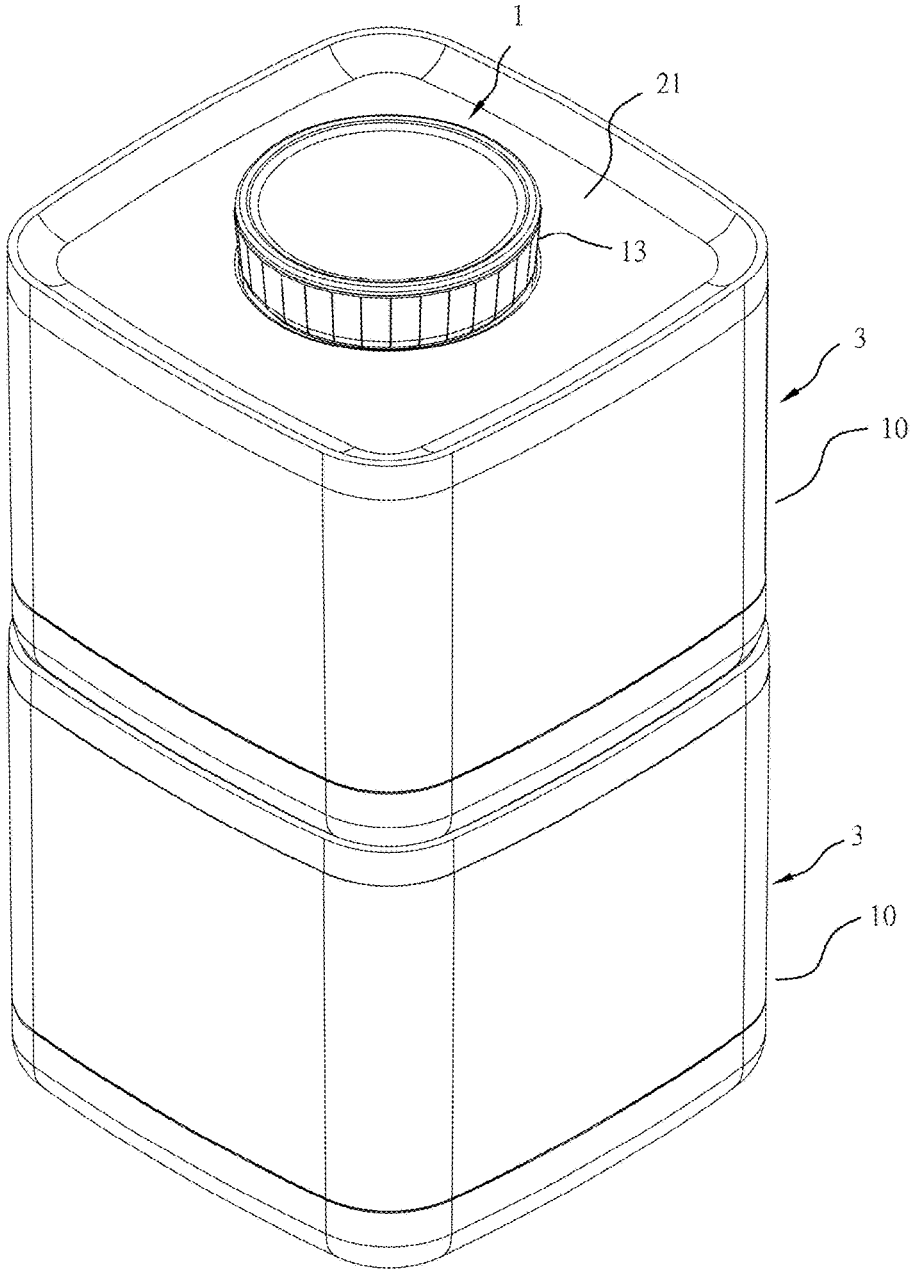
FIG. 12 is an oblique top elevational view illustrating two hermetic food containers arranged in a stack in accordance with the first embodiment of the present invention.

The guide seat 5 comprises a center mounting hole 52 fastened to the rotary knob 1 with a fastener 7 for synchronous rotation with the rotary knob 1, at least one guide block 51 (see FIGS. 1, 3 and 11). Each guide block 51 defines a guiding surface 511 sloping downwardly from one end thereof to an opposite end thereof (see FIGS. 3 and 11) for guiding the rotary knob 1 to move downward relative to the top cover 2 when the rotary knob 1 is rotated in a second direction, for example, counter-clockwise direction.

The gasket ring 6 is fastened to the position-limiting groove 111 of the bottom stem 11 of the rotary knob 1. When the rotary knob 1 is lifted relative to the top cover 2 to a certain extent, the gasket ring 6 will be stopped at an inner peripheral wall 251 of the coupling hole 25 of the top cover 2 (see FIG. 10) to achieve the sealing effect. When the rotary knob 1 is lowered relative to the top cover 2, a gap 27 will be created between the gasket ring 6 and the inner peripheral wall 251 of the coupling hole 25 of the top cover 2 (see FIG. 11).

Based on the aforesaid structural composition of the hermetic food container 10 in accordance with the first embodiment of the present invention, when the rotary knob 1 is rotated in the first direction, i.e., clockwise direction, the rotary knob 1 is moved upward relative to the top cover 2 (see FIG. 10) subject to the guidance of the guiding surface 261 of each lift guiding block 26 at the face panel 21 of the top cover 2, causing the gasket ring 6 to be lifted with the bottom stem 11 of the rotary knob 1 into abutment against the inner peripheral wall 251 of the coupling hole 25 of the top cover 2 (see FIG. 10), and thus, the expected sealing effect is achieved. On the contrary, when the rotary knob 1 is rotated in the second direction, i.e., counter-clockwise direction, the rotary knob 1 is moved downward relative to the top cover 2 (see FIG. 10) subject to the guidance of the guiding surface 511 of each guide block 51 of the guide seat 5, causing creation of a gap 27 between the gasket ring 6 and the inner peripheral wall 251 of the coupling hole 25 of the top cover 2 (see FIG. 11) for allowing air to go therethrough into the container body 3. At this time, the user can open the top cover 2 easily.

Figure 4:
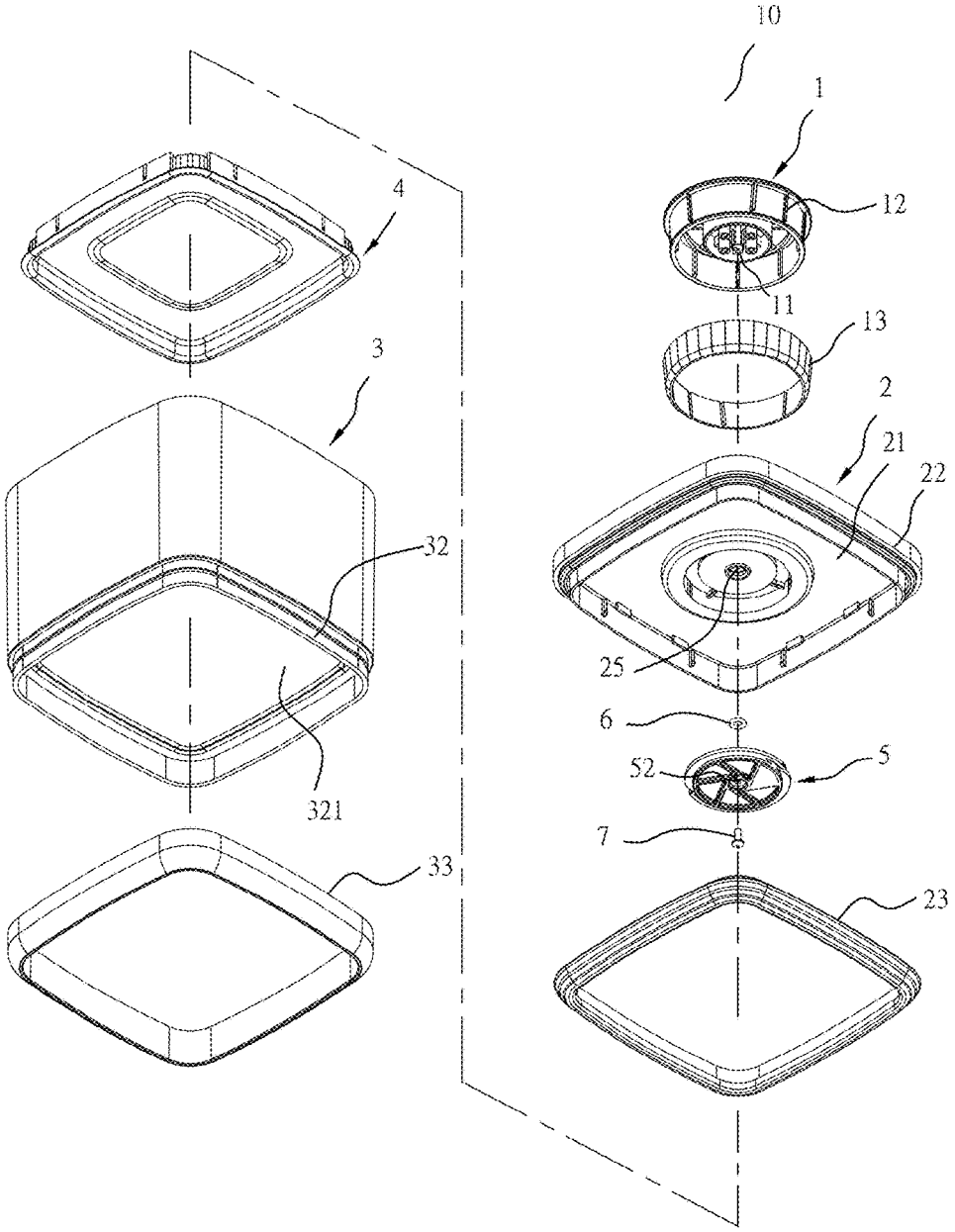
FIG. 4 corresponds to FIG. 1 when viewed from another angle.
Figure 5:
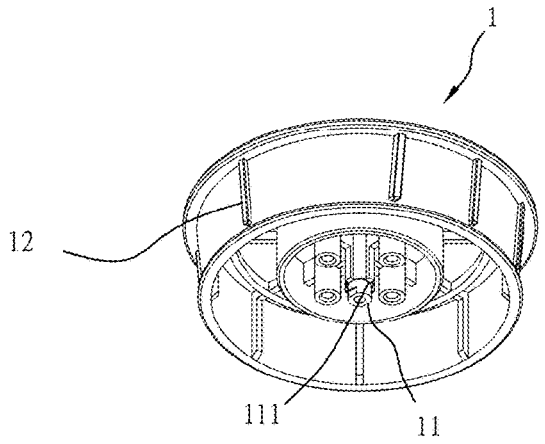
FIG. 5 is an oblique bottom elevational view of the rotary knob of the hermetic food container in accordance with the first embodiment of the present invention.
Figure 6:
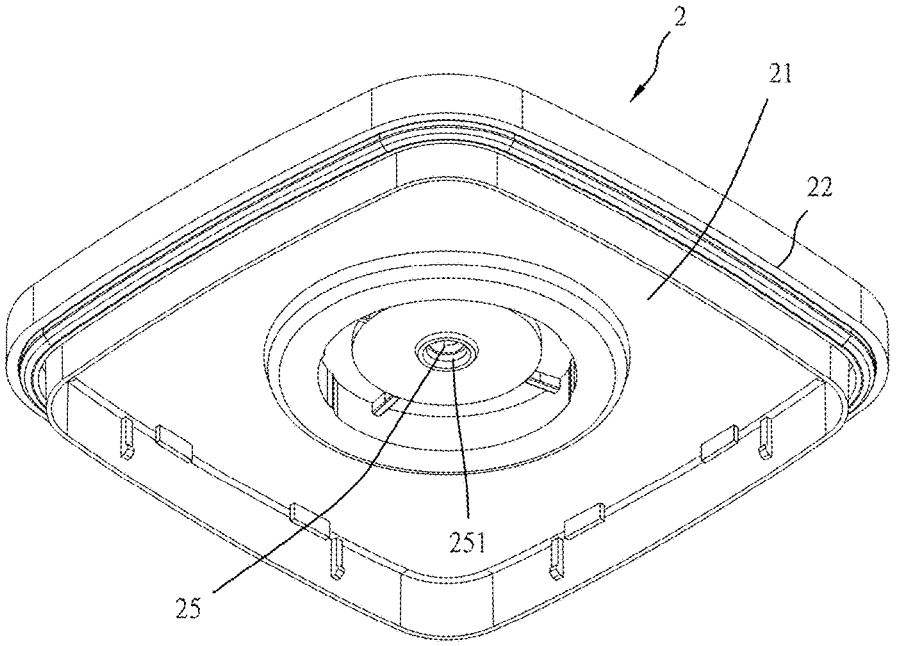
FIG. 6 is an oblique bottom elevational view of the top cover of the hermetic food container in accordance with the first embodiment of the present invention.
Figure 7:
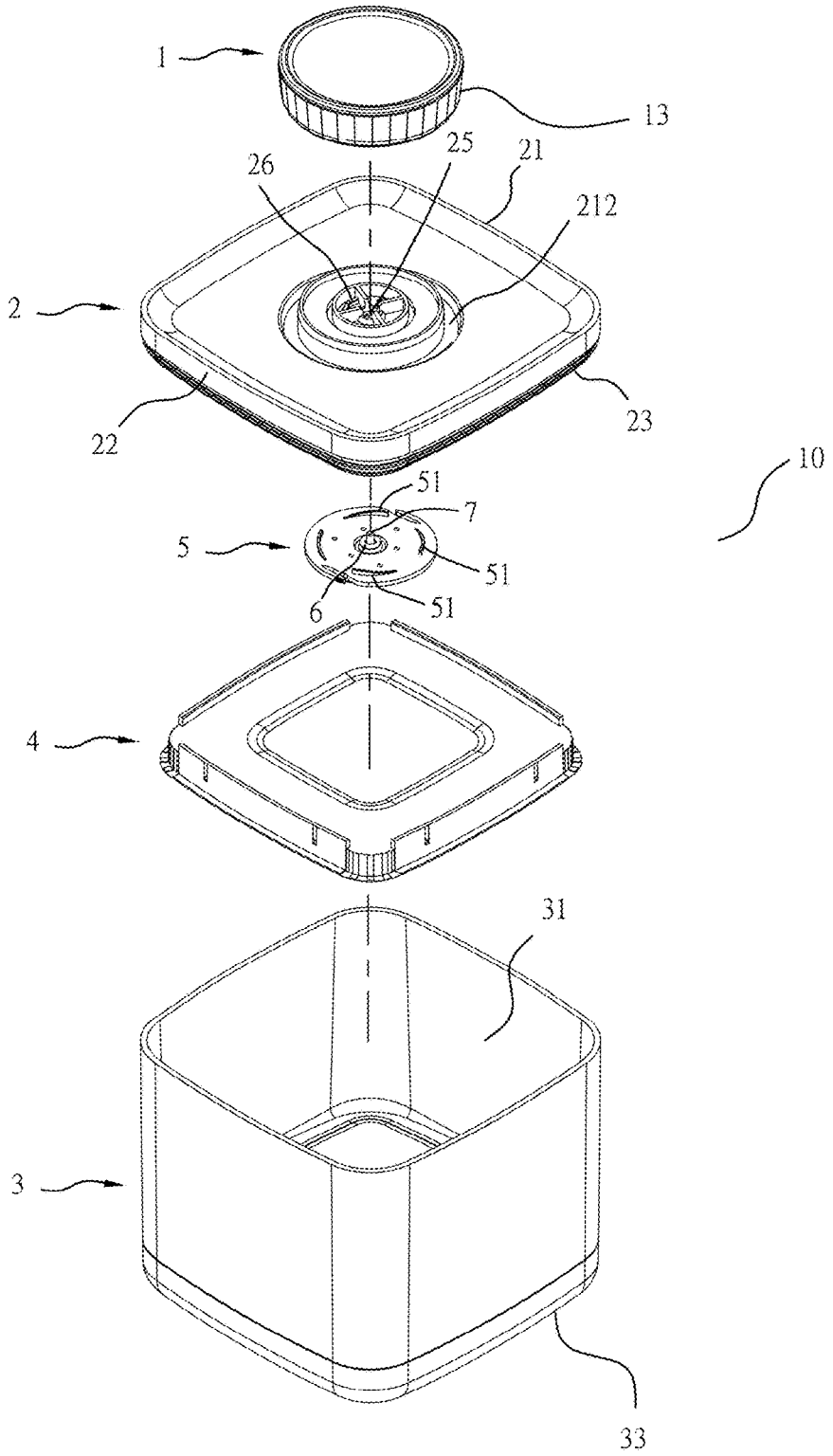
FIG. 7 is an exploded and partially assembled view of the hermetic food container in accordance with the first embodiment of the present invention.
Figure 8:
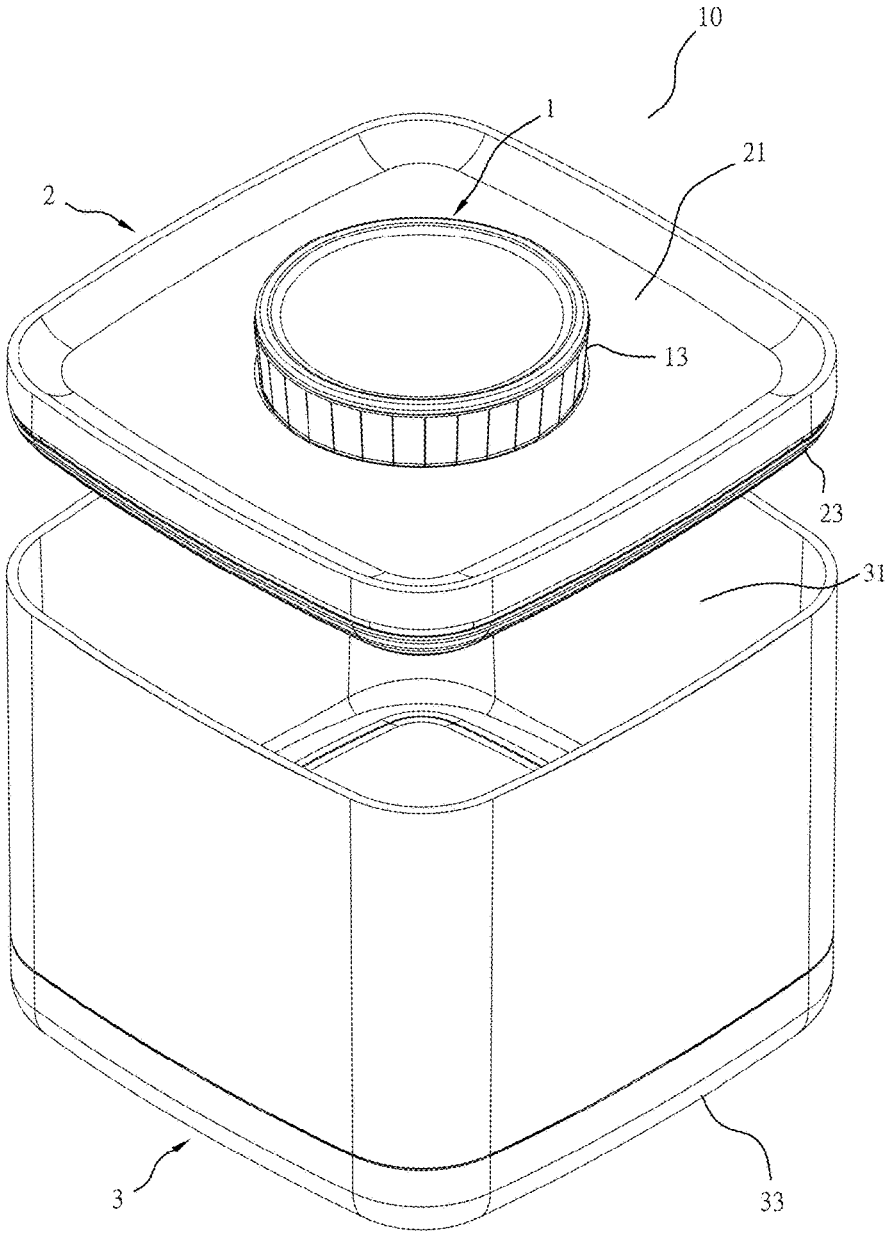
FIG. 8 is an oblique top elevational view of the first embodiment of the present invention, illustrating the top cover opened from the container body.
Figure 9:
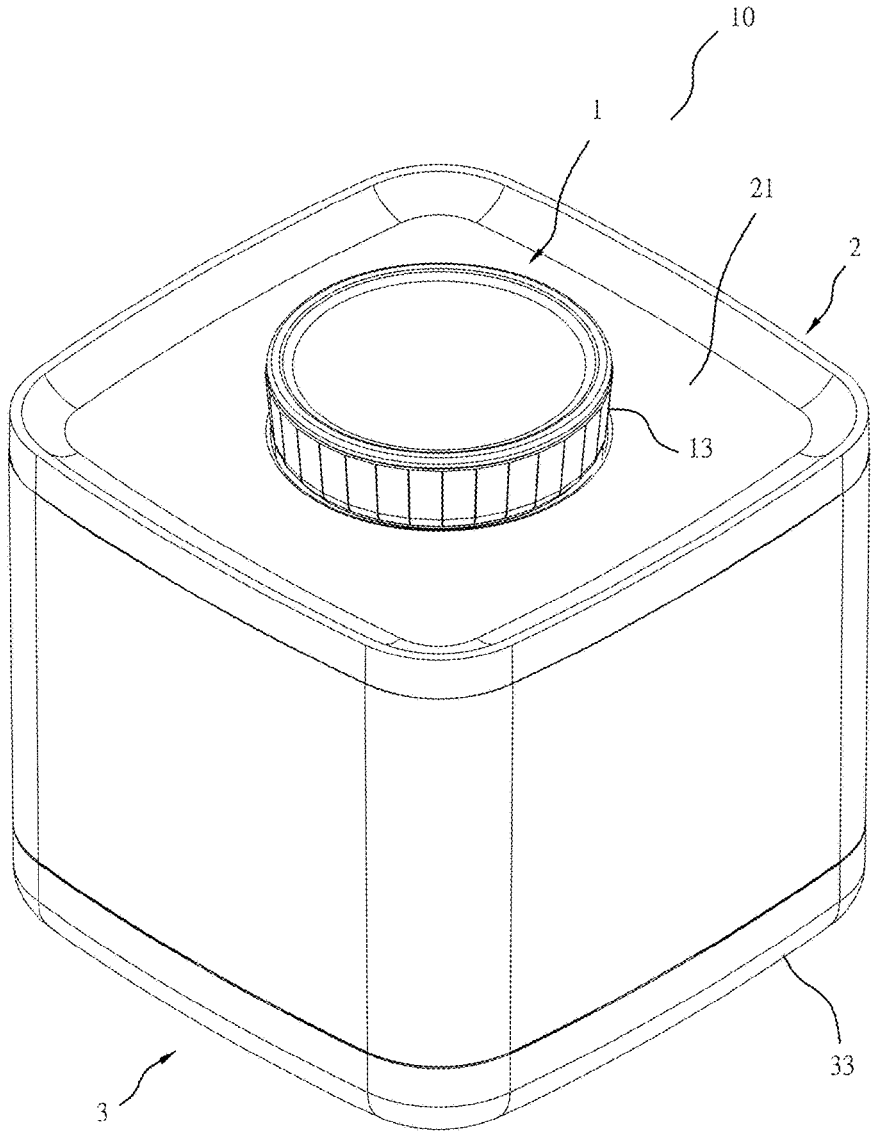
FIG. 9 is an oblique top elevational assembly view of the hermetic food container in accordance with the first embodiment of the present invention.
Figure 10:
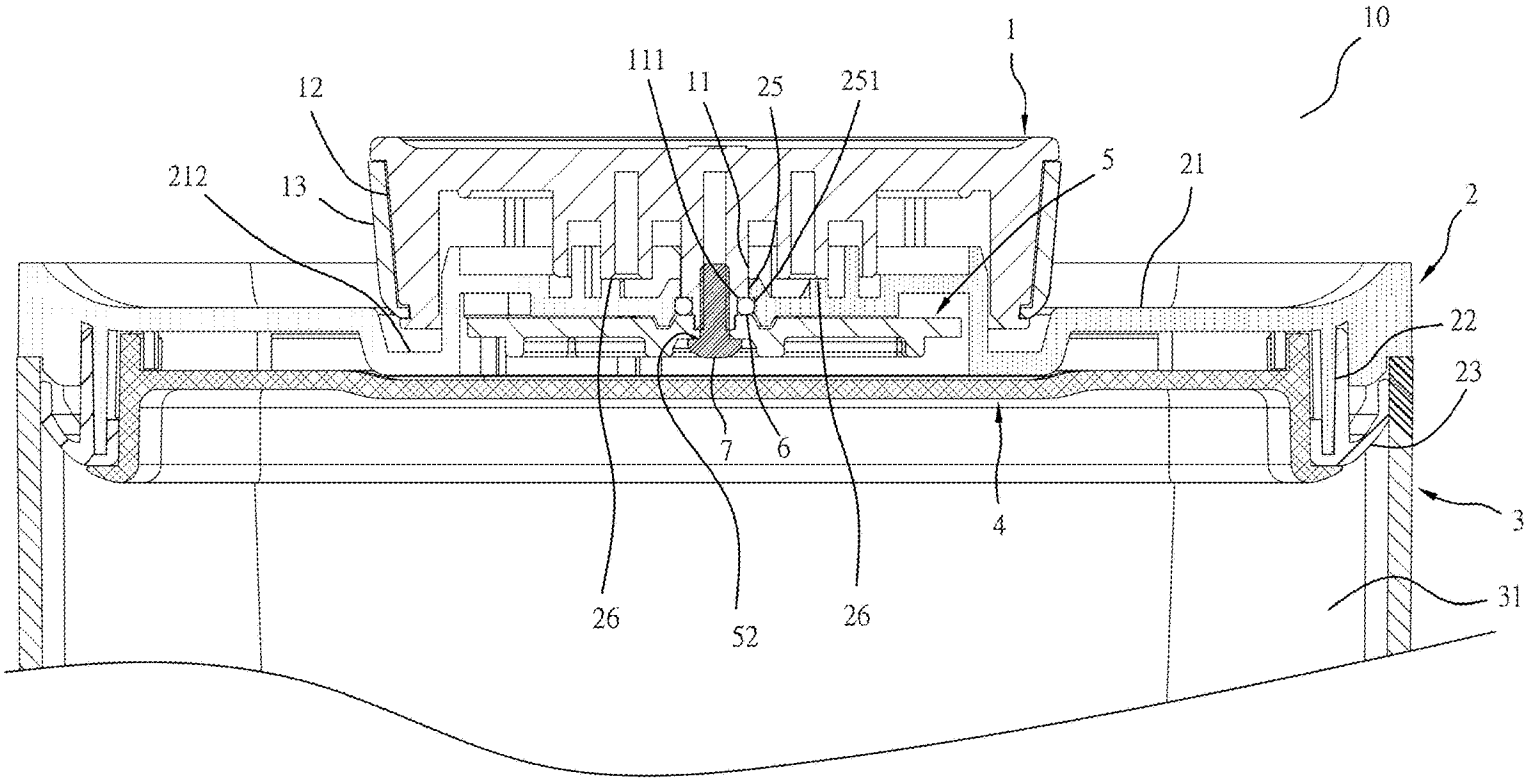
FIG. 10 is a schematic sectional view of a part of the first embodiment of the present invention, illustrating the hermetic food container well sealed in an airtight condition.
Figure 13:
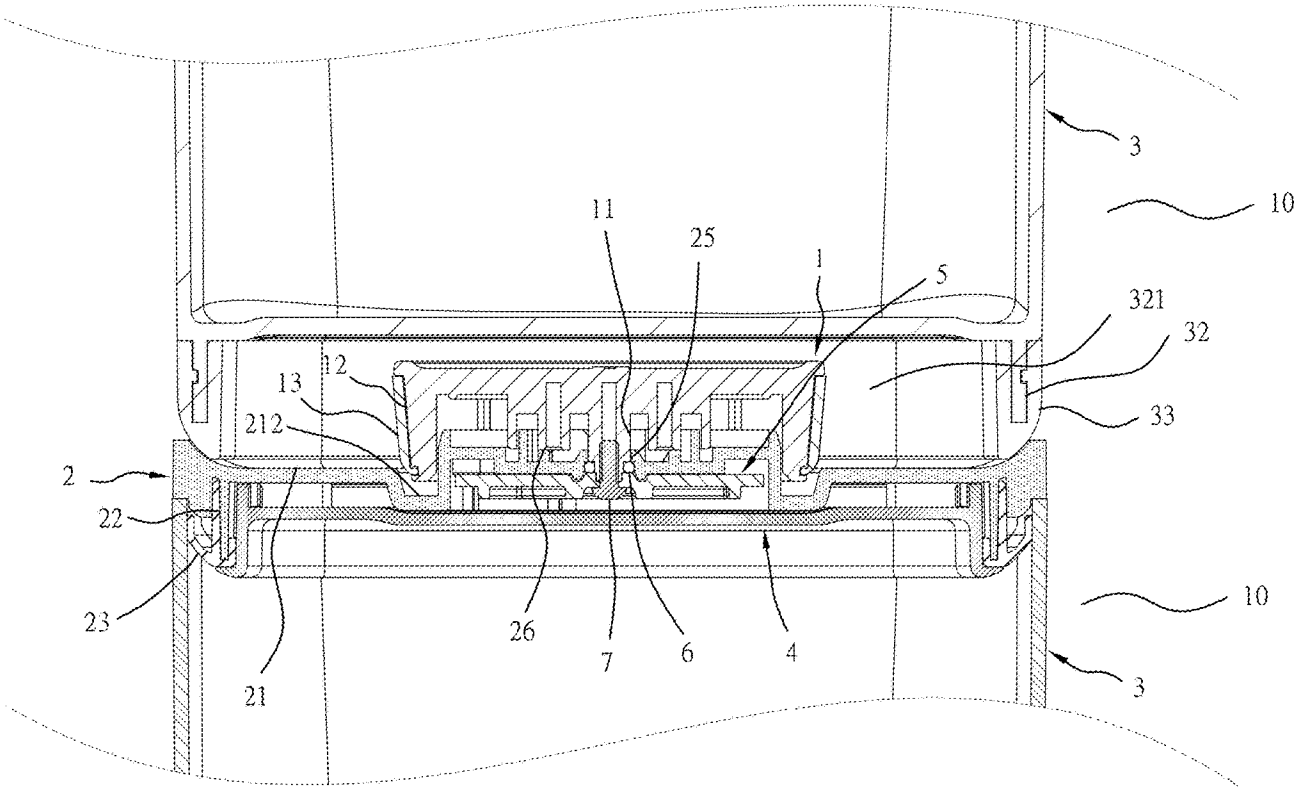
FIG. 13 is a schematic sectional view illustrating two hermetic food containers arranged in a stack in accordance with the first embodiment of the present invention.

The container body 3 further comprises a bottom rim 32 downwardly extended from the border of a bottom side thereof and defining therein an accommodation space 321 (see FIGS. 1, 4 and 13). Further, an anti-slip cushion 33 is fastened to the bottom rim 32 of the container body 3. The anti-slip cushion 33 is configured to fit the recessed configuration of the top side of the face panel 21 of the top cover 2 of the hermetic food container 10 (see FIGS. 12 and 13). Thus, multiple hermetic food containers 10 can be arranged in a stack with the rotary knob 1 of one hermetic food container 10 received in the accommodation space 321 of the bottom rim 32 of the container body 3 of another hermetic food container 10 without causing interference (see FIGS. 12 and 13), facilitating storage, package and delivery.

Further, the face panel 21 of the top cover 2 can be configured to provide an annular groove 212 (see FIGS. 1, 2, 10 and 11) for receiving the annular peripheral wall 12 of the rotary knob 1.

Figure 14:
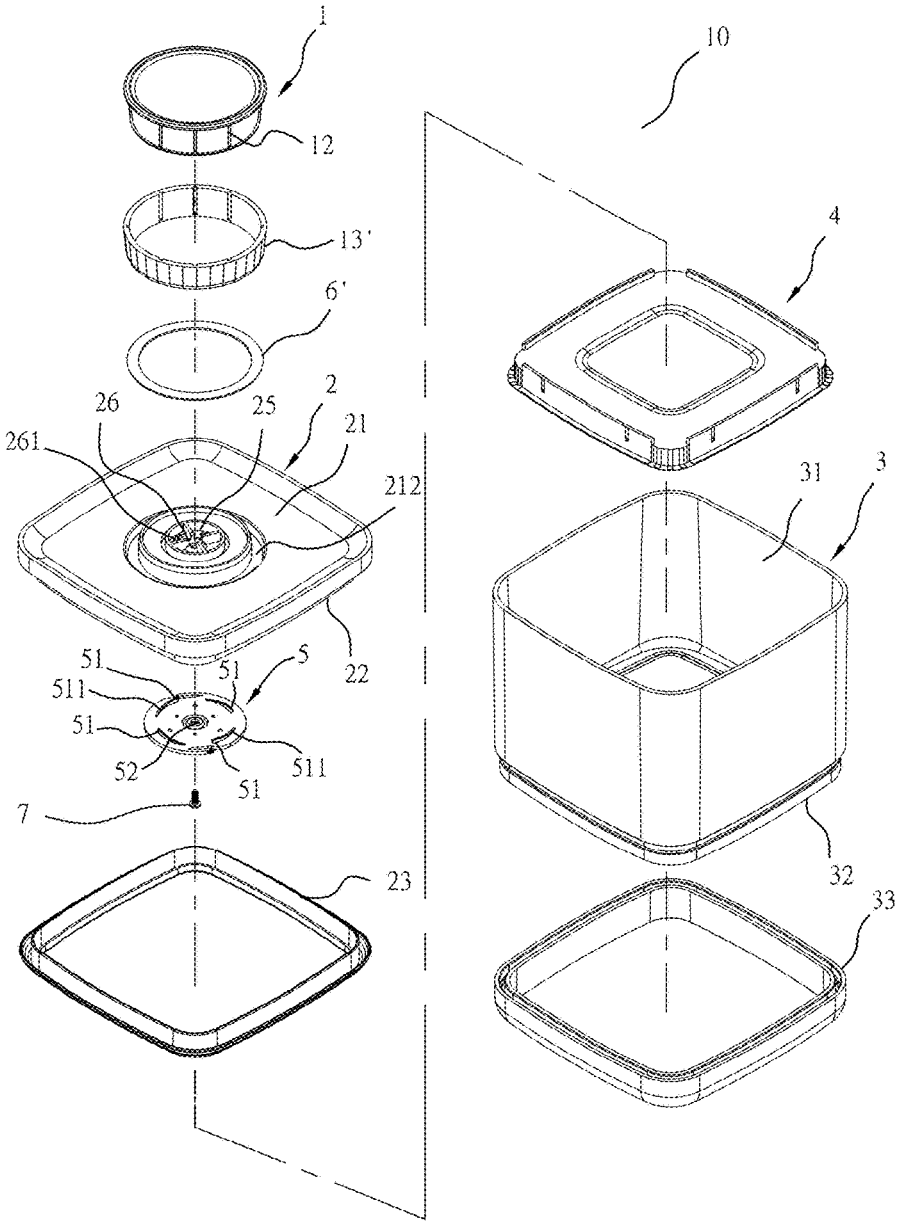
FIG. 14 is an exploded view of a hermetic food container in accordance with a second embodiment of the present invention.
Figure 15:
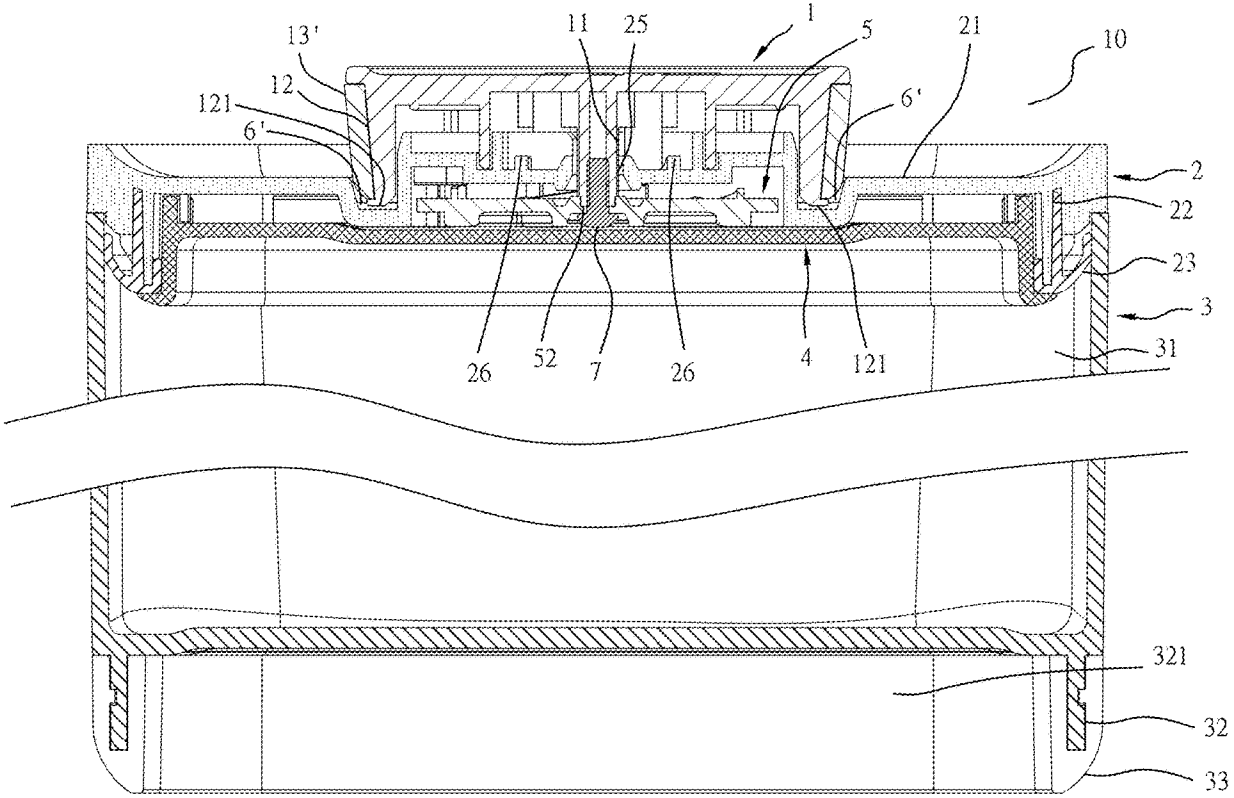
FIG. 15 is a schematic sectional view of a part of the second embodiment of the present invention, illustrating the hermetic food container well sealed in an airtight condition.
Figure 16:
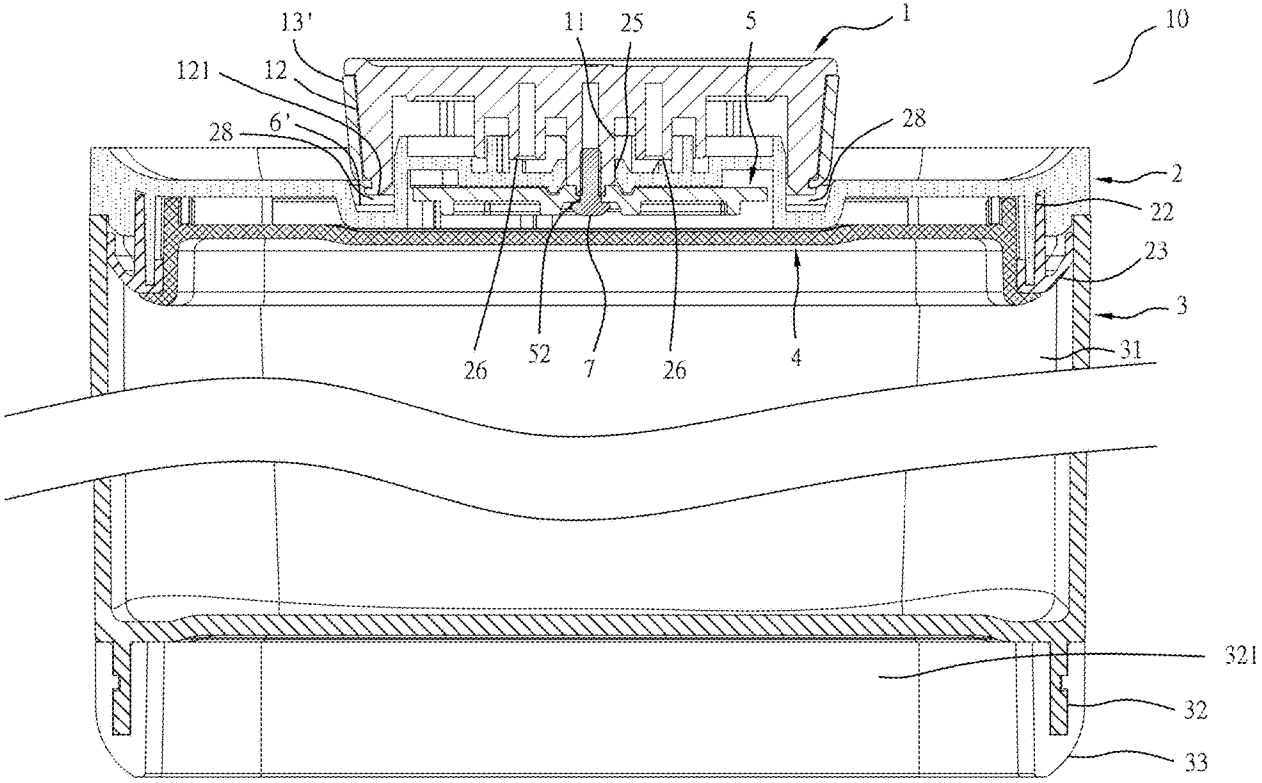
FIG. 16 is similar to FIG. 15, illustrating a gap created between the gasket ring and the bottom edge of the annular peripheral wall of the rotary knob.
Figure 17:
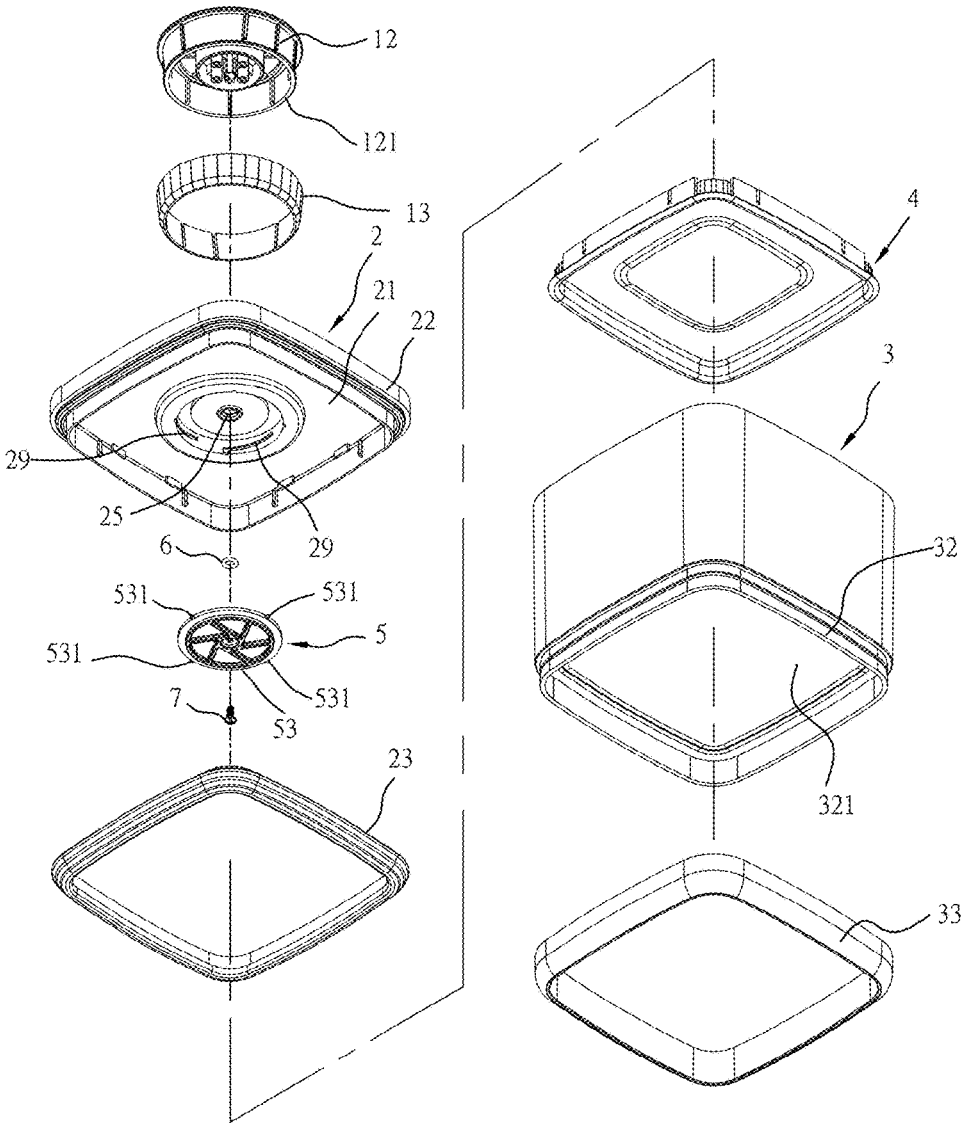
FIG. 17 is an exploded view of a hermetic food container in accordance with a third embodiment of the present invention.
Figure 18:
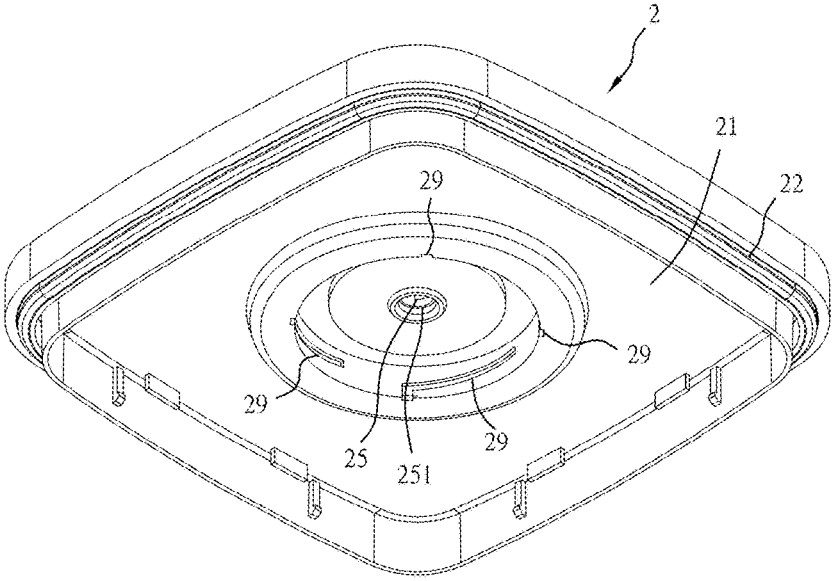
FIG. 18 is an oblique bottom elevational view of the top cover of the hermetic food container in accordance with the third embodiment of the present invention.
Figure 19:
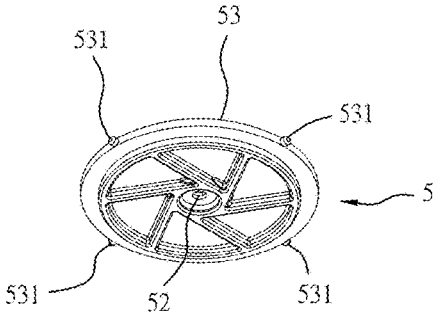
FIG. 19 is an oblique bottom elevational view of the guide seat of the hermetic food container in accordance with the third embodiment of the present invention.

Referring to FIGS. 14-16, a hermetic food container 10 in accordance with a second embodiment of the present invention is shown. The hermetic food container 10 of this second embodiment comprises a rotary knob 1, a top cover 2, a container body 3, an ornamental cover 4, a guide seat 5, and a gasket ring 6'.

The rotary knob 1 is rotatably connected to a top side of the top cover 2, comprising a bottom stem 11 (see FIGS. 14 and 15) downwardly inserted through the top cover 2 and fastened to the guide seat 5 with a fastener 7 (see FIGS. 14-16). The rotary knob 1 further comprises an annular peripheral wall 12, and an anti-slip cushion 13' mounted around the annular peripheral wall 12.

The top cover 2 is capped on the container body 3, comprising a face panel 21, a rim 22 extended around the border of the face panel 21, a packing rubber 23 fastened to the rim 22, a coupling hole 25 cut through opposing top and bottom walls of the face panel 21 at the center and rotatably coupled with the bottom stem 11 of the rotary knob 1, and at least one lift guiding block 26 located on the top wall of the face panel 21 (see FIGS. 14-16). Each lift guiding block 26 comprises a guiding surface 261 sloping downwardly from one end thereof to an opposite end thereof for guiding the rotary knob 1 to move upward relative to the top cover 2 when the rotary knob 1 is rotated in a first direction, for example, clockwise direction. Further, the face panel 21 of the top cover 2 is configured to provide an annular groove 212 for receiving the annular peripheral wall 12 and the anti-slip cushion 13' of the rotary knob 1.

The container body 3 defines an open-top storage chamber 31 for storing things or foods.

The ornamental cover 4 is fastened to a bottom side of the top cover 2.

The guide seat 5 comprises a center mounting hole 52 fastened to the rotary knob 1 with a fastener 7 for synchronous rotation with the rotary knob 1, at least one guide block 51 (see FIGS. 14-16). Each guide block 51 defines a guiding surface 511 sloping downwardly from one end thereof to an opposite end thereof for guiding the rotary knob 1 to move downward relative to the top cover 2 when the rotary knob 1 is rotated in a second direction, for example, counter-clockwise direction.

The gasket ring 6' is fastened to the annular groove 212 of the top cover 2. When the rotary knob 1 is lifted relative to the top cover 2 to a certain extent, the gasket ring 6' will be stopped at a bottom edge 121 of the annular peripheral wall 12 of the rotary knob 1 (see FIG. 15) to achieve the sealing effect. When the rotary knob 1 is lowered relative to the top cover 2, a gap 28 will be created between the gasket ring 6' and the bottom edge 121 of the annular peripheral wall 12 of the rotary knob 1 (see FIG. 16).

Based on the aforesaid structural composition of the hermetic food container 10 in accordance with the second embodiment of the present invention, when the rotary knob 1 is rotated in the first direction, i.e., clockwise direction, the rotary knob 1 is moved upward relative to the top cover 2 (see FIG. 15) subject to the guidance of the guiding surface 261 of each lift guiding block 26 at the face panel 21 of the top cover 2, causing the gasket ring 6' to be stopped by the bottom edge 121 of the annular peripheral wall 12 of the rotary knob 1 (see FIG. 15), and thus, the expected sealing effect is achieved. On the contrary, when the rotary knob 1 is rotated in the second direction, i.e., counter-clockwise direction, the rotary knob 1 is moved downward relative to the top cover 2 subject to the guidance of the guiding surface 511 of each guide block 51 of the guide seat 5, causing creation of a gap 28 between the gasket ring 6' and the bottom edge 121 of the annular peripheral wall 12 of the rotary knob 1 (see FIG. 16) for allowing air to go therethrough into the container body 3. At this time, the user can open the top cover 2 easily.

The container body 3 further comprises a bottom rim 32 downwardly extended from the border of a bottom side thereof and defining therein an accommodation space 321 (see FIGS. 15 and 16). Further, an anti-slip cushion 33 is fastened to the bottom rim 32 of the container body 3. The anti-slip cushion 33 is configured to fit the recessed configuration of the top side of the face panel 21 of the top cover 2 of the hermetic food container 10. Thus, multiple hermetic food containers 10 can be arranged in a stack with the rotary knob 1 of one hermetic food container 10 received in the accommodation space 321 of the bottom rim 32 of the container body 3 of another hermetic food container 10 without causing interference, facilitating storage, package and delivery.

Referring to FIGS. 17-22, a hermetic food container 10 in accordance with a third embodiment of the present invention is shown. The hermetic food container 10 of this third embodiment comprises a rotary knob 1, a top cover 2, a container body 3, an ornamental cover 4, a guide seat 5, and a gasket ring 6.

The rotary knob 1 is rotatably connected to a top side of the top cover 2, comprising a bottom stem 11 (see FIGS. 20-22) downwardly inserted through the top cover 2 and fastened to the guide seat 5 with a fastener 7 (see FIG. 17 and FIGS. 20-22). The bottom stem 11 has a position-limiting groove 111 extended around the periphery near the distal end thereof (see FIGS. 20-22). The rotary knob 1 further comprises an annular peripheral wall 12, and an anti-slip cushion 13 mounted around the annular peripheral wall 12.

Figure 20:
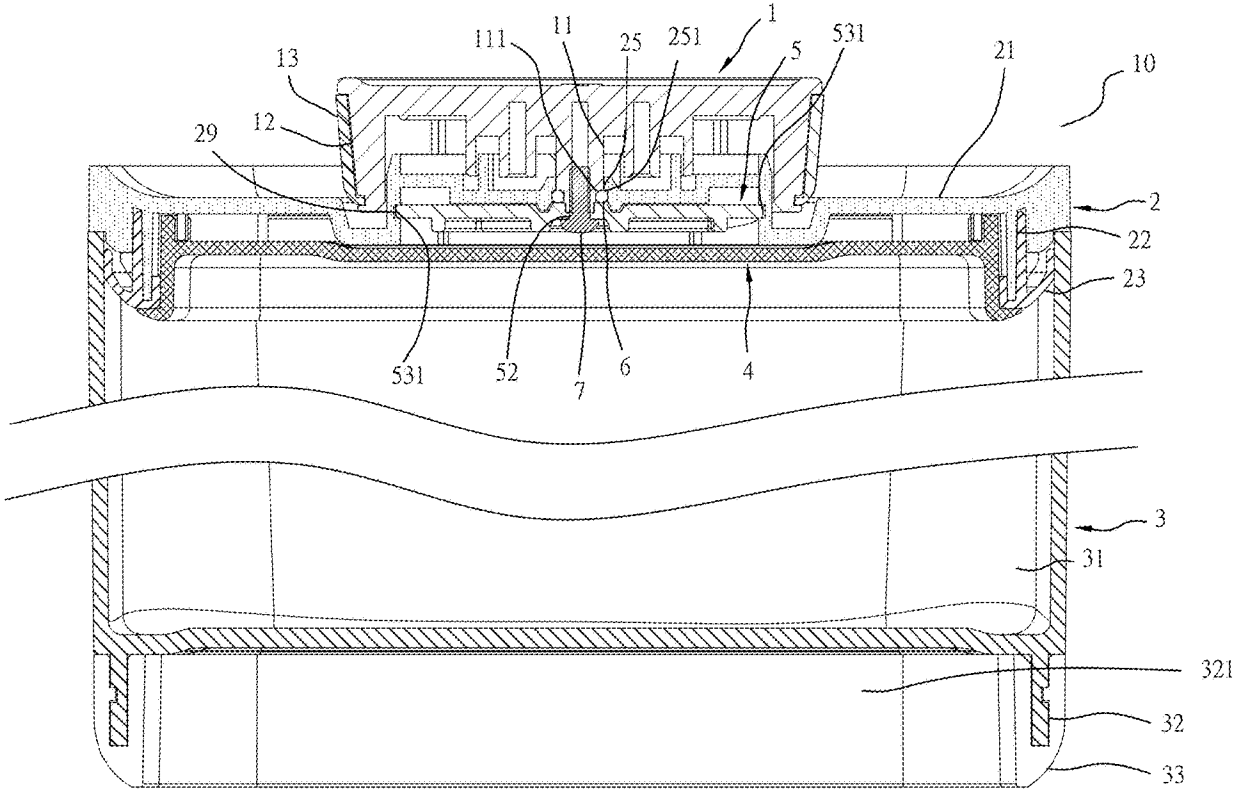
FIG. 20 is a schematic sectional view of a part of the third embodiment of the present invention, illustrating the hermetic food container well sealed in an airtight condition.
Figure 21:
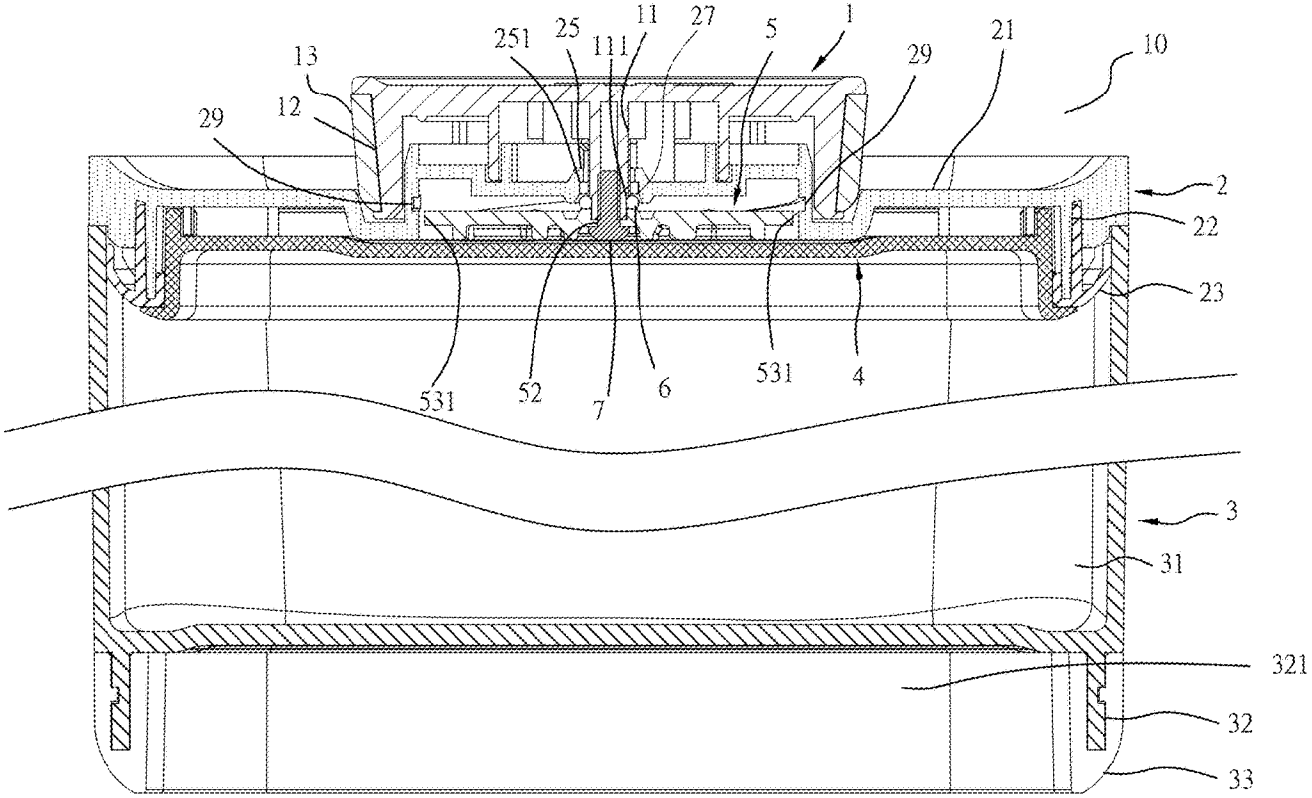
FIG. 21 is similar to FIG. 20, illustrating a gap created between the gasket ring and the inner peripheral wall of the coupling hole of the top cover.
Figure 22:
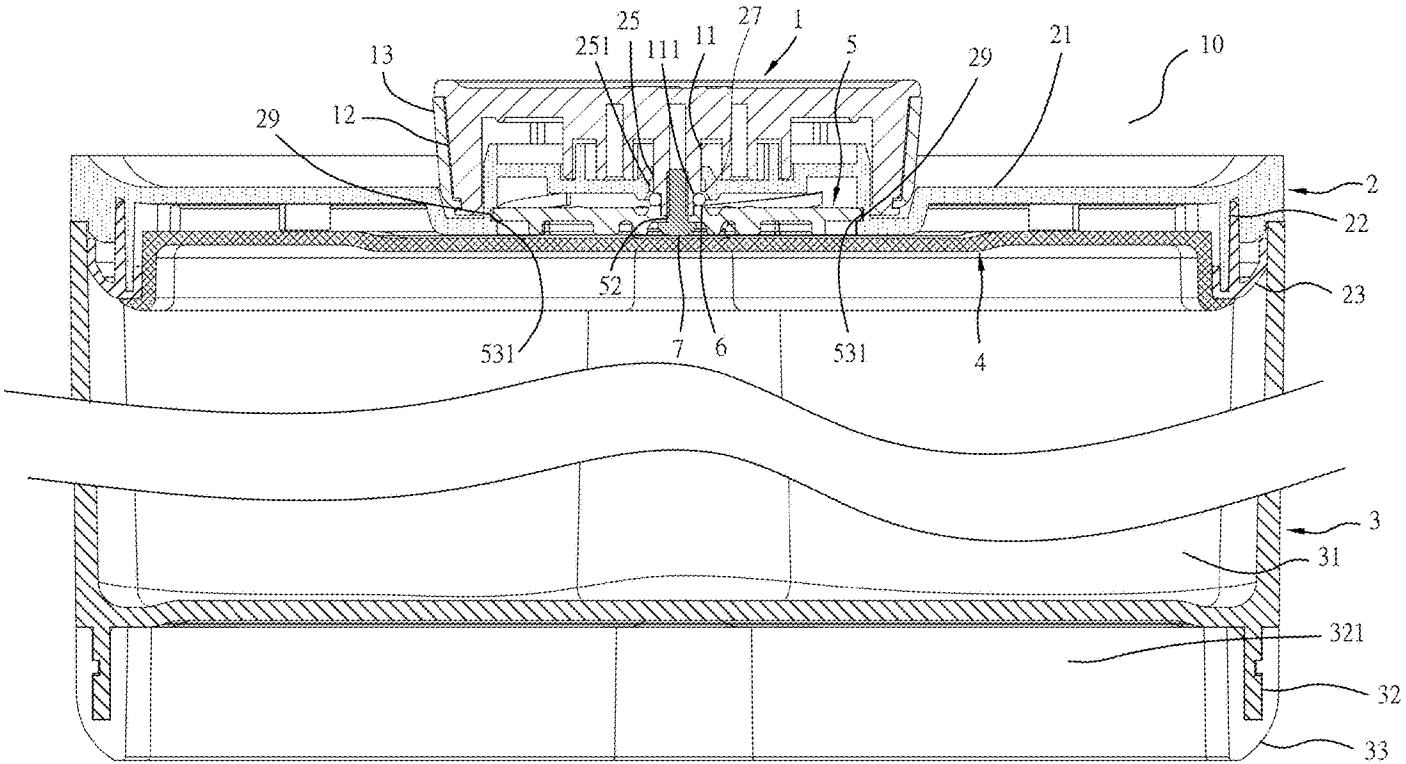
FIG. 22 is similar to FIG. 21 when viewed from another angle.

The top cover 2 is capped on the container body 3, comprising a face panel 21, a rim 22 extended around the border of the face panel 21, a packing rubber 23 fastened to the rim 22, a coupling hole 25 cut through opposing top and bottom walls of the face panel 21 at the center and rotatably coupled with the bottom stem 11 of the rotary knob 1 (see FIGS. 17 and 18 and FIGS. 20-22), and at least one lifting guide groove 29 located on a bottom wall of the face panel 21 (see FIGS. 17 and 18) and sloping downwardly from one end thereof to an opposite end thereof (see FIG. 17) for guiding the rotary knob 1 to move upwardly or downwardly relative to the top cover 2 when the rotary knob 1 is rotated in the first direction, i.e., clockwise direction, or the second direction, i.e., counter-clockwise direction (see FIGS. 20-22).

The container body 3 defines an open-top storage chamber 31 for storing things or foods.

The ornamental cover 4 is fastened to a bottom side of the top cover 2.

The guide seat 5 comprises a center mounting hole 52 fastened to the rotary knob 1 with a fastener 7 for synchronous rotation with the rotary knob 1, and at least one lifting guide block 531 located on a circular peripheral wall 53 thereof (see FIG. 17) and respectively coupled to the respective at least one lifting guide groove 29 of the top cover 2. Thus, when the rotary knob 1 is rotated in the first direction, i.e., clockwise direction, or the second direction, i.e., counter-clockwise direction, the at least one lifting guide block 531 is moved upwardly (see FIG. 20) or downwardly (see FIGS. 21 and 22) along the respective at least one lifting guide groove 29 of the top cover 2.

The gasket ring 6 is fastened to the position-limiting groove 111 of the bottom stem 11 of the rotary knob 1. When the rotary knob 1 is lifted relative to the top cover 2 to a certain extent, the gasket ring 6 will be stopped at an inner peripheral wall 251 of the coupling hole 25 of the top cover 2 (see FIG. 20) to achieve the sealing effect. When the rotary knob 1 is lowered relative to the top cover 2, a gap 27 will be created between the gasket ring 6 and the inner peripheral wall 251 of the coupling hole 25 of the top cover 2 (see FIGS. 21 and 22).

Based on the aforesaid structural composition of the hermetic food container 10 in accordance with the third embodiment of the present invention, when the rotary knob 1 is rotated in the first direction, i.e., clockwise direction, the at least one lifting guide block 531 of the guide seat 5 is guided by the respective at least one lifting guide groove 29 of the face panel 21 of the top cover to move upward, and thus, the rotary knob 1 is moved with the guide seat 5 upwardly relative to the top cover 2 (see FIG. 20), forcing the gasket ring 6 at the bottom stem 11 of the rotary knob 1 to abut against an inner peripheral wall 251 of the coupling hole 25 of the top cover 2 (see FIG. 20), and thus, the expected sealing effect is achieved. On the contrary, when the rotary knob 1 is rotated in the second direction, i.e., counter-clockwise direction, the at least one lifting guide block 531 of the guide seat 5 is guided by the respective at least one lifting guide groove 29 of the face panel 21 of the top cover to move downward, causing creation of a gap 27 between the gasket ring 6 and the inner peripheral wall 251 of the coupling hole 25 of the top cover 2 (see FIGS. 21 and 22). Thus, air can go through the gap 27 into the container body 3. At this time, the user can open the top cover 2 easily.

The container body 3 of the hermetic food container 10 in accordance with this third embodiment of the present invention further comprises a bottom rim 32 downwardly extended from the border of a bottom side thereof and defining therein an accommodation space 321 (see FIGS. 20-22). Further, an anti-slip cushion 33 is fastened to the bottom rim 32 of the container body 3. The anti-slip cushion 33 is configured to fit the recessed configuration of the top side of the face panel 21 of the top cover 2 of the hermetic food container 10. Thus, multiple hermetic food containers 10 can be arranged in a stack with the rotary knob 1 of one hermetic food container 10 received in the accommodation space 321 of the bottom rim 32 of the container body 3 of another hermetic food container 10 without causing interference, facilitating storage, package and delivery.

In conclusion, the invention provides a hermetic food container 10 that has the advantages and features as follows:

1. The rotary knob 1 is rotatable to move upward or downward relative to the top cover 2, moving the gasket ring 6 to achieve a sealing effect, or to create a gap 27,28 for ventilation for enabling the top cover 2 to be opened easily.

2. Using the gasket ring 6 to achieve the expected sealing effect avoids an elastic fatigue problem to lower the sealing performance due to the use of a spring and, using the gasket ring 6 to substitute for a spring can relatively reduce wear, enhance durability and prolong the lifespan of the hermetic food container 10.

3. The anti-slip cushion 33 is mounted at the bottom side of the container body 3 to provide an anti-slip function, allowing multiple hermetic food containers 10 to be arranged in a stack (see FIGS. 12 and 13) convenient for storage, package and delivery.

What is claimed is:

1. A hermetic food container, comprising a rotary knob, a top cover, a container body, an ornamental cover, a guide seat and a gasket ring, wherein:

said rotary knob is rotatably connected to a top side of said top cover, comprising a bottom stem downwardly inserted through said top cover and fastened to said guide seat with a fastener, a position-limiting groove extended around the periphery of said bottom stem, an annular peripheral wall spaced around said bottom stem, and an anti-slip cushion mounted around said annular peripheral wall;

said top cover is capped on said container body, comprising a face panel, a rim extended around the border of said face panel, a packing rubber fastened to said rim, a coupling hole cut through opposing top and bottom walls of said face panel at the center and rotatably coupled with said bottom stem of said rotary knob, and at least one lift guiding block located on the top wall of said face panel, each said lift guiding block comprising a guiding surface sloping downwardly from one end thereof to an opposite end thereof for guiding said rotary knob to move upward relative to said top cover when said rotary knob is rotated in a first direction;

said container body defines therein an open-top storage chamber;

said ornamental cover is fastened to a bottom side of said top cover;

said guide seat is fixedly fastened to said rotary knob for synchronous rotation, comprising at least one guide block, each said guide block defines a guiding surface sloping downwardly from one end thereof to an opposite end thereof for guiding said rotary knob to move downward relative to said top cover when said rotary knob is rotated in a second direction reversed to said first direction;

said gasket ring is fastened to said position-limiting groove of said bottom stem of the rotary knob so that when said rotary knob is lifted relative to said top cover, said gasket ring is forced into abutment against an inner peripheral wall of said coupling hole of said top cover to achieve a sealing effect; when said rotary knob is lowered relative to said top cover, a gap is created between said gasket ring and said inner peripheral wall of said coupling hole of said top cover.

2. The hermetic food container as claimed in claim 1, wherein said container body further comprises a bottom rim downwardly extended from the border of a bottom side thereof and defining therein an accommodation space, and an anti-slip cushion fastened to said bottom rim; said face panel of said top cover provides a recessed configuration in a top side thereof fitting the configuration of said anti-slip cushion.

* * * * *